US008434632B2

(12) United States Patent
Boubeddi et al.

(10) Patent No.: US 8,434,632 B2
(45) Date of Patent: May 7, 2013

(54) MEAL TRAYS

(75) Inventors: Aziz Boubeddi, Hoofddorp (NL); Paul Merrill, Los Angeles, CA (US)

(73) Assignee: MAG Aerospace Industries, Inc., Carson City, CA (US)

( * ) Notice: Subject to any disclaimer, the term of this patent is extended or adjusted under 35 U.S.C. 154(b) by 66 days.

(21) Appl. No.: 13/050,415

(22) Filed: Mar. 17, 2011

(65) Prior Publication Data

US 2011/0226661 A1 Sep. 22, 2011

Related U.S. Application Data

(60) Provisional application No. 61/314,656, filed on Mar. 17, 2010.

(51) Int. Cl.
*A47G 19/00* (2006.01)
*B65D 21/02* (2006.01)

(52) U.S. Cl.
USPC ..... 220/23.6; 220/23.83; 206/511

(58) Field of Classification Search ..... 220/4.26, 220/4.27, 23.6, 23.83, 556; 206/511, 561; 99/DIG. 14; 219/621
See application file for complete search history.

(56) References Cited

U.S. PATENT DOCUMENTS

| | | | | |
|---|---|---|---|---|
| 3,478,867 | A * | 11/1969 | Weiss | 206/564 |
| 5,628,241 | A | 5/1997 | Chavanaz et al. | |
| 5,950,828 | A * | 9/1999 | Bal | 206/370 |
| 6,359,268 | B1 | 3/2002 | Walter | |
| 7,615,727 | B2 | 11/2009 | Walter | |
| 2003/0213718 | A1 * | 11/2003 | Ducharme et al. | 206/503 |
| 2010/0155391 | A1 | 6/2010 | Koschberg et al. | |

FOREIGN PATENT DOCUMENTS

| | | | |
|---|---|---|---|
| DE | 19818831 | A1 | 10/1999 |
| EP | 1518487 | A1 | 3/2005 |
| EP | 1709895 | A1 | 10/2006 |
| WO | WO0386882 | A1 | 10/2003 |

OTHER PUBLICATIONS

International Search Report and Written Opinion dated Sep. 1, 2011 in Application No. PCT/US2011/028787.
International Preliminary Report on Patentability dated Sep. 27, 2012 in Application No. PCT/US2011/028787.

* cited by examiner

*Primary Examiner* — Harry Grosso
(74) *Attorney, Agent, or Firm* — Dean W. Russell; Kristin M. Crall; Kilpatrick Townsend & Stockton LLP

(57) ABSTRACT

Embodiments of the present invention provide stackable meal trays for use in transporting and heating meal casseroles in an induction oven.

15 Claims, 7 Drawing Sheets

MEAL TRAYS

This application claims the benefit of U.S. Provisional Application Ser. No. 61/314,656, filed Mar. 17, 2010 titled "Meal Carrier," the entire contents of which are hereby incorporated by reference.

FIELD OF THE INVENTION

Embodiments of the present invention relate generally to trays that are designed to be stackable, transportable, and inserted directly into a galley oven for heating prior to serving.

BACKGROUND

Passengers traveling on-board passenger transportation vehicles, such as aircraft, for trips of any duration are typically served one or more hot meals. Aircraft galleys are typically equipped with steam or convection ovens for preparing the hot meals. While steam and convection ovens have been standard, the trend is expected to be toward using induction ovens in aircraft galleys, which use heated coils and induction waves to heat food. It is desirable that any new catering processes for use with preparing food in induction ovens match as closely as possible the current catering processes used for steam and convection ovens.

The catering logistics and processes for conventional heating ovens (such as steam and hot air circulation convection ovens) are somewhat standard. Food prepared at the catering location is put in individual aluminum casseroles, and the individual casseroles are placed in metallic trays. The trays are then placed in metallic meal carriers. The catering company delivers the loaded metallic meal carriers directly to the aircraft (with the meals either chilled or frozen), and the meal carriers are stowed directly into the oven. In flight, the meals are re-heated to the desired temperature.

To serve the meals, a flight attendant positions a hot meal casserole into a separate metallic tray before serving it to a passenger. When the catering service is finished, the separate metallic trays are returned to the oven. In case of a second catering service (e.g., on a long flight), new loaded metallic trays are used. When the aircraft is back on the ground, the catering company removes the empty meal carriers and replaces them with loaded ones. The carriers and trays are then cleaned at the catering location and ready for re-use.

Inductions ovens currently being developed and envisioned for use on board aircraft and other passenger transport vehicles have oven cavities that are divided into multiple shelves. Induction coils are disposed in the shelves and heat food placed thereon. The food to be heated will be provided in individual casseroles and introduced into the oven and positioned on the shelves to be heated. A schematic view of an exemplary induction-type oven for use in an aircraft galley is shown in FIGS. 13 and 14, which illustrate an oven cavity 100 having a series of shelves 102 with an open column 104 therebetween.

Rather than providing individual casseroles that need to be positioned individually on each shelf, the open column is designed to accommodate portions of a meal carrier that may be positioned completely inside the oven. This allows for the expected catering logistics for induction ovens to track as closely as possible the catering logistics for conventional ovens. For example, rather than requiring single cassettes that contain meal casseroles that need to be loaded individually into the oven, it is preferable to provide a carrier that can transport and contain a number of meal casseroles at once.

One example of a meal carrier system that has been designed for use with induction ovens is shown and described in U.S. Publication No. 2010/0155391, titled "Galley Oven for Preparing Food on Board an Aircraft." The present application describes a different system that removes the need to use a complete meal carrier, but instead provides a modular tray system that can easily be transported and positioned in the induction oven.

BRIEF SUMMARY

Embodiments of the present invention provide a series of meal trays that can be used in the aircraft in combination with an induction oven without affecting the catering logistic processes described. The trays have casseroles receiving portions, as well as space-creating features to create a space between each tray when stacked. They further comprise one or more elements for securing the trays to one another when in a stacked configuration. The elements may be a base assembly, a cover assembly, and a securing system.

Further embodiments provide a meal tray system with at least first and second stackable trays. Each tray has a tray body and a central divider dividing the tray into a left casserole-receiving portion and a right casserole-receiving portion. Each portion has an upper guiding rail and a lower guiding rail such that the upper guiding rail of one tray cooperates in use with the lower guiding rail on another tray to create a space between the stacked tray bodies. A base assembly and a cover assembly are provided in order to secure the trays in place, and can be strapped together with a securing system, such as a belt.

DETAILED DESCRIPTION

Figure 13:
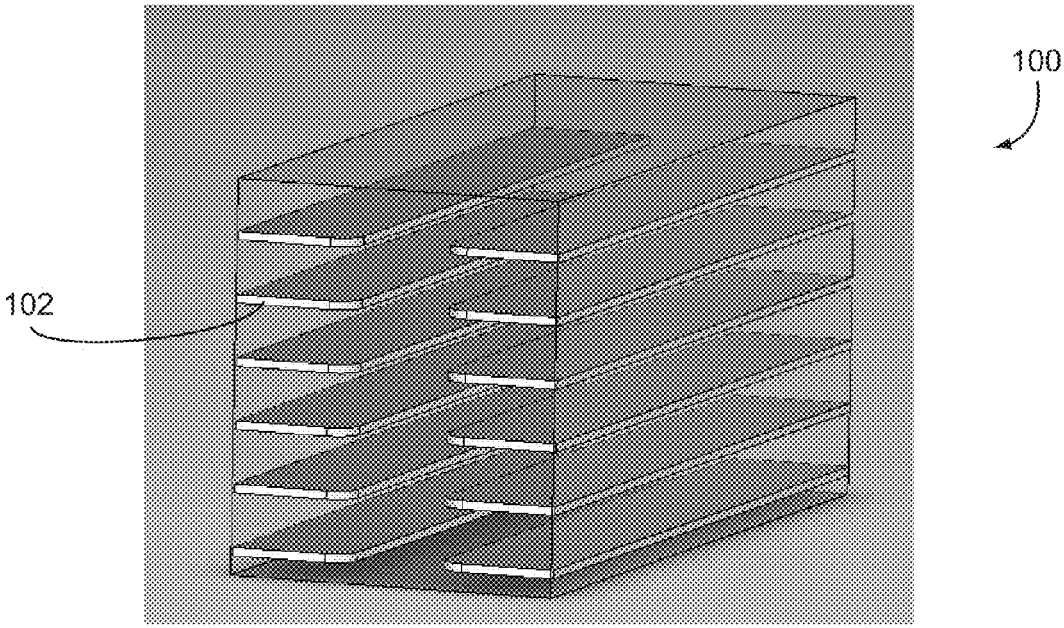
FIG. 13 shows a side perspective view of one embodiment of an induction oven for use with various embodiments described.
Figure 14:
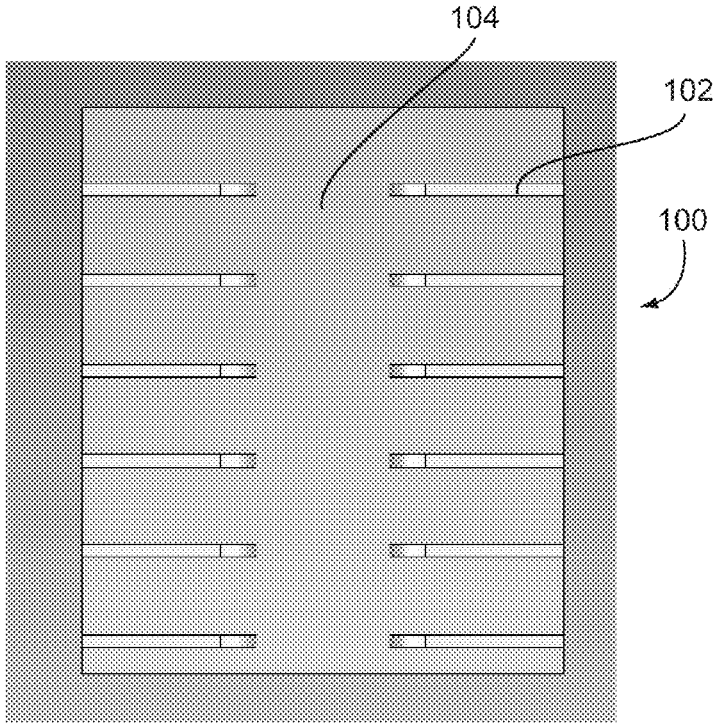
FIG. 14 shows a front plan view of the induction oven of FIG. 13.

Embodiments of the present invention provide stackable meal trays that can be used to load, transport, and heat meal casseroles for consumption on-board passenger transport vehicles. Specific embodiments are for particular use with induction ovens on-board aircraft. The stackable trays described herein provide a solution that will make it possible for airlines to switch from traditional heating methods (such as convection and steam ovens) to induction heating technology without having to change their catering process. The trays described are designed to minimize the impact on the actual catering logistics, namely the preparation of the meals in the casseroles, the loading of the casseroles in the trays, the cooling process, loading into the aircraft, the catering service, off loading from the aircraft, and the cleaning process. The trays can be stacked in a configuration that closely resembles the shape and size of meal carriers that are currently provided in the market. However, the stackable trays provided herein are particularly designed for use with induction ovens, examples of which are shown in FIGS. 13 and 14.

Induction ovens 100 for use with passenger transport vehicles, such as aircraft, are designed with a series of shelves 102 that line the left and right hand sides of the oven cavity. Each shelf 102 of the induction oven has an induction coil, which is used to heat the individual meal casserole placed on that shelf. Between each group of left and right hand shelves 102 is an open column 104. These ovens are being designed with open columns 104 in order to accommodate various meal carrier designs that are currently on the market. Accordingly, the stackable trays described herein are designed with such induction oven designs in mind and are configured to fit into the ovens and accommodate current catering processes with little to no process alterations.

Figure 1:
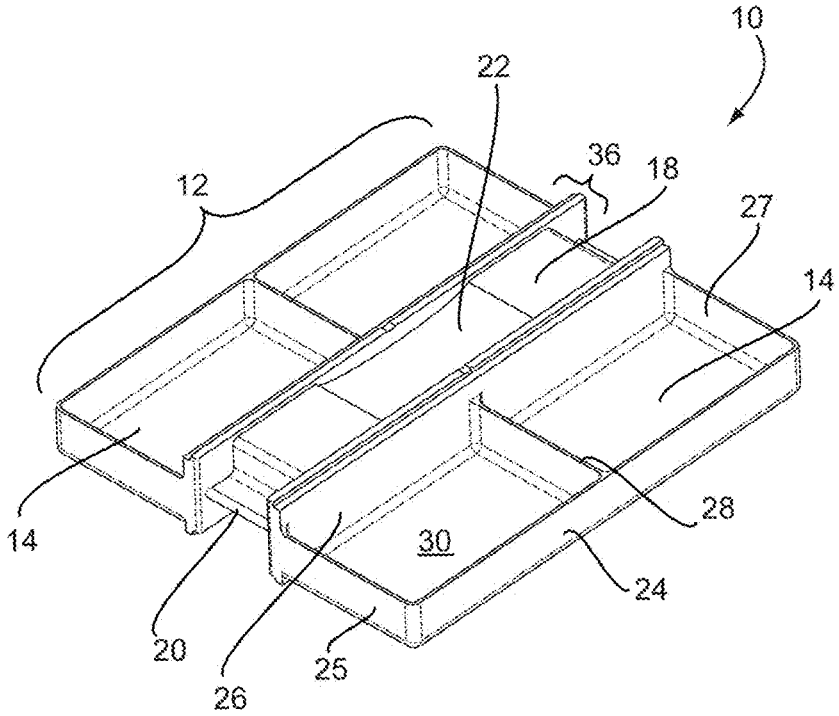
FIG. 1 shows a top perspective view of one embodiment of a stackable tray.
Figure 2:
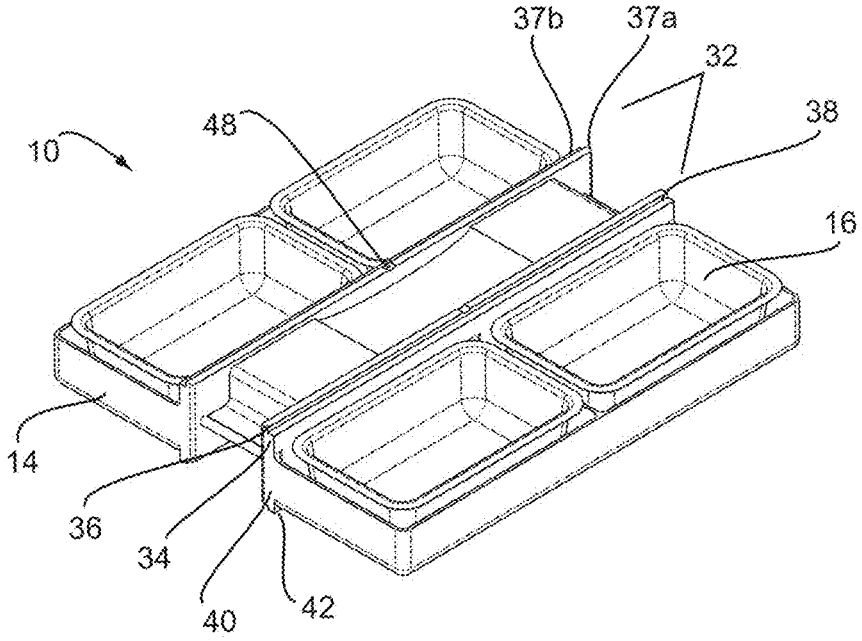
FIG. 2 shows a top perspective view of the tray of FIG. 1 with meal casseroles positioned therein.
Figure 3:
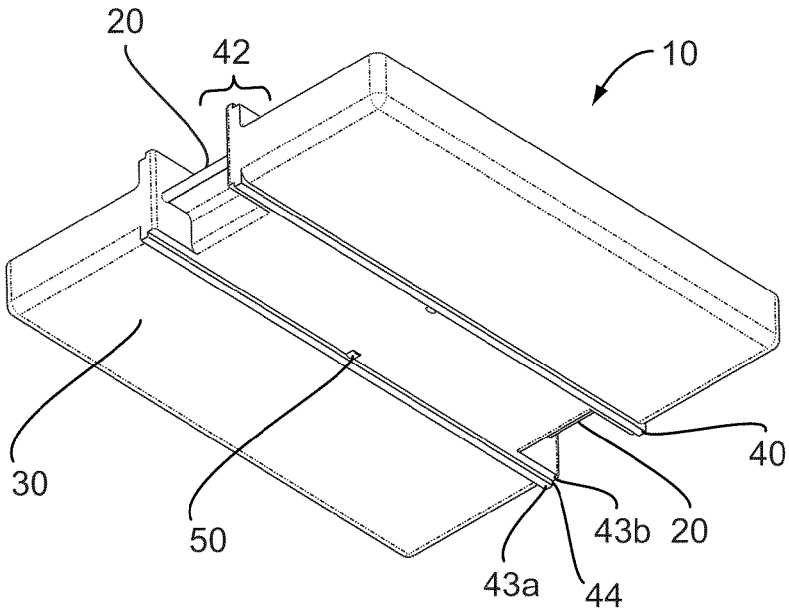
FIG. 3 shows a bottom perspective view of the tray of FIG. 1.

For perspective, FIGS. 1-3 show various views of a stackable tray 10 according to one embodiment of the invention, and FIGS. 6-12 show various views of a plurality of trays in a stacked configuration. As shown in FIG. 1, stackable tray 10 comprises a tray body 12 with a plurality of similarly-sized casserole-receiving portions 14. FIG. 2 shows the stackable tray 10 with an individual, pre-packaged meal casserole 16 positioned in each of the casserole-receiving portions 14. Although the option of having four rectangular casserole-receiving portions is shown, it should be understood that any number and shape of casserole-receiving portions 14 may be provided and is considered within the scope of this invention. For example, if smaller meal casseroles are to be provided, it is possible to design a tray having six or eight portions 14, or if larger meals are to be provided, the tray may have as few as two portions 14.

In the embodiment shown, the tray 10 is divided into left and right sides by a central divider 18. Central divider 18 provides support for the tray 10, and it may also act as a handle 20. In a particular embodiment, a handle 20 is provided on both the "front" and the "back" of the tray, which actually eliminates there being a front and a back of the tray, such that it can be inserted into the oven in either direction.

An upper surface of the central divider is shown having at least a portion that forms an inwardly curved surface 22. Inwardly curved surface 22 is provided to allow space for a user's hand during carrying, as described in more detail below.

The embodiment shown also illustrates two casserole-receiving portions 14 on each side of the tray 10. In this embodiment, the portions 14 on each side may share an outer wall 24, an inner wall 26, a front wall 25, a back wall 27, and be divided in half (or thirds or fourths, depending upon the number of portions to be provided) by at least one shared wall 28. Shared wall 28 acts as a separation feature in order to maintain the casseroles at a pre-defined positions because the casseroles should be positioned directly on the top of the induction coils in order to thoroughly heat or cook. Portions 14 also have a bottom area 30 into which the meal casserole 16 rests in use. Either the inner wall 26 or a portion of the central divider 18 provides a space-creating feature 32. Generally, space-creating feature 32 provides structures that allow the trays to key onto one another so that they can easily stack, as well as to keep them aligned.

In the specific embodiment shown, the space-creating feature 32 is provided by a raised shoulder 34 provided on the upper part of the inner wall 26, which results in the inner wall 26 being at least slightly higher than the outer wall 24. Raised shoulder 34 may be formed as a guiding rail 36 with an internal notch 38 extending the length thereof. In a specific embodiment, guiding rail 36 may have first and second legs 37*a*, 37*b* that are separated by the notch 38 such that first leg 37*a* is slightly higher than second leg 37*b* to create an "L" shape.

The corresponding cooperating feature is a lowered foot 40 provided on the lower side of the inner wall 26, which results in the inner wall 26 extending at least slightly lower than the outer wall 24. Lowered foot 40 may be formed as a lower guiding rail 42 with an internal notch 44 extending the length thereof. In a specific embodiment, guiding rail 42 may have first and second legs 43*a*, 43*b* that are separated by the notch 44 such that first leg 43*a* is slightly lower than second leg 43*b* to create an upside down "L" shape. As shown in FIG. 1, raised shoulder 34 and lowered foot 40 collectively result in portion 14 resembling a capital "T" on its side.

While raised shoulder 34 and lowered foot 40 are shown and described as positioned on the inner wall 26, it should be understood that these space-creating features 32 may be provided on the outer wall 24, on the central divider 18, or anywhere along front, back, or shared walls 25, 27, 28 if desired. The general concept is to provide a space between the tray bodies 10 when in a stacked configuration such that the bottom area 30 of the tray can rest upon an oven shelf, as described further below.

The tray 10 also features a stacked positioning system 46. The positioning system 46 shown in the figures includes a positioning notch 48 along at least a portion of the raised shoulder 34 or guiding rail 36 or both, as well as a positioning protrusion 50 along at least a portion of the lowered foot 40 or lower guiding rail 42 or both. FIGS. 1 and 2 show one example of a positioning notch 48 positioned on the top part of tray 10, and FIG. 3 shows one example of a positioning protrusion 50 positioned on the under part of the tray 10. It should be understood, however, that the notch and protrusion may reverse positions, with the protrusion 50 positioned on the upper part of the tray and the notch 48 positioned on the under part of the tray. The notch 48 and protrusion 50 of two separate trays are designed to cooperate with one another when the two trays are stacked on top of one another in order to provide a positioning system 46 that secures the trays from sliding with respect to one another during transit of the completed assembly. The positioning system 46 does not necessarily need to be so secure that the trays are completely stabilized and unmovable with respect to one another; instead, it should generally be configured such that enough force (e.g., a user pulling out one of the trays from the assembly as show in FIG. 12) will allow the trays to disengage from one another.

Figure 4:
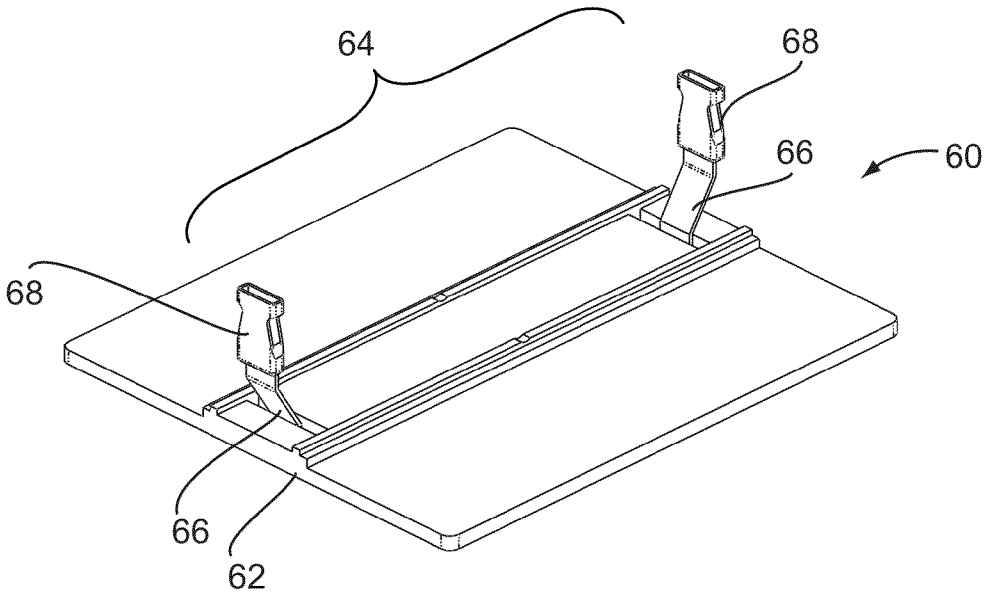
FIG. 4 shows a top perspective view of one embodiment of a base assembly.

FIG. 4 shows one embodiment of a base assembly 60. Base assembly has a guiding rail 62 that is similar in shape and configuration to one of the guiding rails 36 and 42 described above. In a particular embodiment, it is configured to have a similar shape and configuration as the guiding rails 36 that are positioned on the upper part of each tray 10 so that it will cooperate appropriately with the guiding rail 42 that is positioned on the under part of first tray that begins the stack. In order to begin a stacking process, the guiding rail 42 of the under part of one tray 10 is positioned on top of the guiding rail 62 of the base assembly 60.

Base assembly 60 also features a securing system 64 that is designed to provide a way to secure a plurality of stacked trays together. In a specific embodiment, securing system may be a belt-type design, with a belt 66 having two clip receiving portions 68. Alternatively, the belt may have two clips 78, or it may be a buckle assembly, a snap assembly, a hook and loop fastener system, or any other appropriate securing system.

Figure 5:
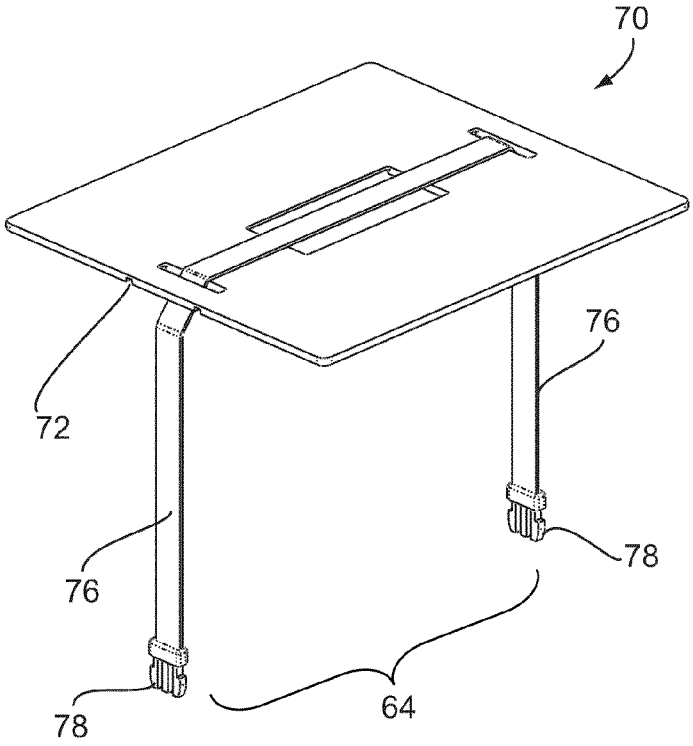
FIG. 5 shows a top perspective view of one embodiment of a cover assembly.

FIG. 5 shows one embodiment of a cover assembly 70. Cover assembly 70 also has a guiding rail 72 that is similar in shape and configuration to one of the guiding rails 36 and 42 described above. In a particular embodiment, it is configured to have a similar shape and configuration as the guiding rails 42 that are positioned on the upper part of each tray 10 so that it will cooperate appropriately with the guiding rail 36 that is positioned on the upper part of the last tray in the stack. Once a tray 10 has been stacked on base assembly 60 and a plurality of trays 10 have been stacked on top of the that tray, cover assembly 70 is positioned so that it cooperates with the guiding rail 36 of the upper part of last tray 10 in the stack.

Cover assembly 60 also features a corresponding component of a securing system 64. In the specific embodiment described above, the securing system component of the cover assembly is a belt 76 having two clips 78. It should be understood, however, that any other securing stem may be used and that the securing components may be interchanged between base and cover assembly. If the belt-design is used, it is possible to provide belts 66, 76 with expandable features so that any number of trays may be stacked and then securely retained together. For example in the embodiments shown in FIGS. 6-12, six trays 10 are stacked, but it should be understood that this design is modifiable to meet various catering needs to the airline.

The secured belt may also be used as carrying handle for the assembled unit. The belt is configured to be secured and detached easily. The belt can also be used to push and pull the assembled unit into and out of the oven, as described below.

For example, it may be the case that only a certain or limited number of vegetarian, low-sodium, low-sugar, or other diet restricted needs may be required for a particular flight. Just as an example, the airline may request four vegetarian meals and four low-sodium meals, with the remainder of the meals being a regular meal selected by the catering company, without any particular specifications. Catering can be made simple with the modular tray system described herein. The catering company could provide the four vegetarian and four low-sodium meals in two trays (with each tray holding each of the four meal casseroles), then those two trays may be secured with a base 60 and cover 70 assembly for easy identification. Alternatively, those meals may be identified with color-coded trays and stacked with the remainder of the regular meals.

Figure 6:
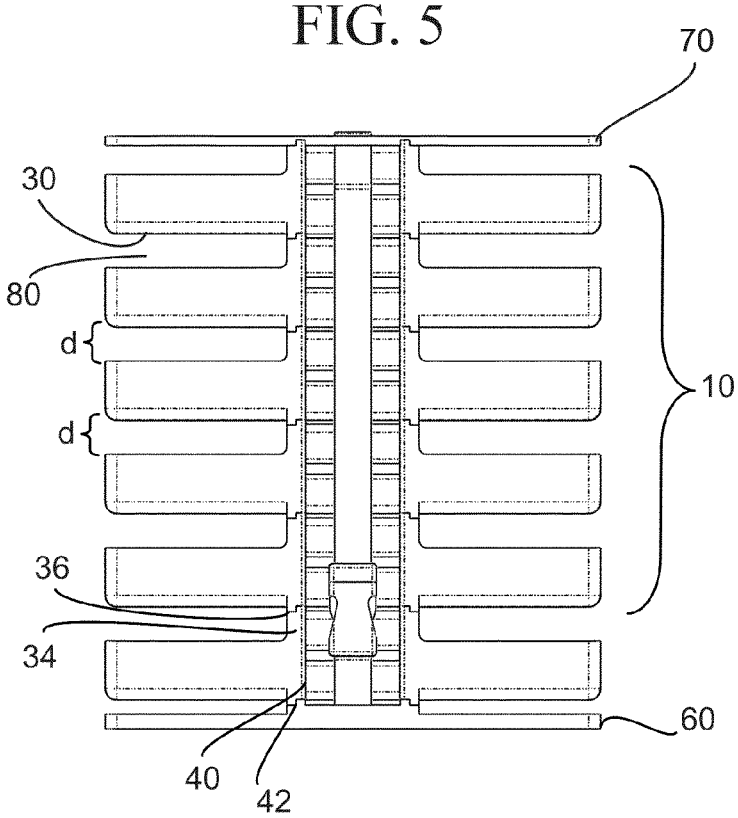
FIG. 6 shows a side plan view of a plurality of trays in a stacked configuration with elements for securing the trays to one another in place.

Referring now to FIGS. 6-12, FIG. 6 shows a plurality of trays stacked upon one another and held in place between a base assembly 60 and a cover assembly 70. In order to best show the cooperation between the guiding rails 36, 42 of raised shoulders 34 and lowered feet 40, FIG. 6 shows the stacked trays without meal casseroles positioned in the trays. As shown, the trays are configured so that there is a space 80 provided featured in order to keep each bottom area 30 of each subsequent tray 10 (which is the contact face for the induction coils) at the same general distance "d" from one another. In a particular embodiment, distance may be anywhere from about two inches to about six inches, depending upon the oven design. The tray dimensions may be any appropriate size that allows them to be used in connection with induction ovens in aircraft galleys, examples of which may be from about 45 to about 65 mm in height, and particularly about 55 in height; from about 250 to about 275 mm wide, and particularly about 265 mm wide; and from about 315 to about 350 mm long, and particularly about 325 mm long.

Figure 7:
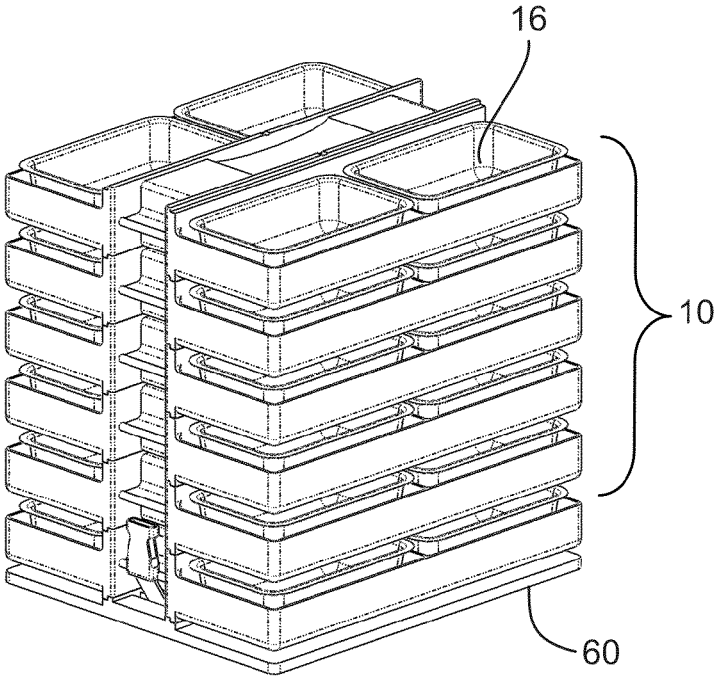
FIG. 7 shows a side perspective view of a plurality of trays in a stacked configuration, with meal casseroles positioned in each tray, loaded on a base assembly.
Figure 8:
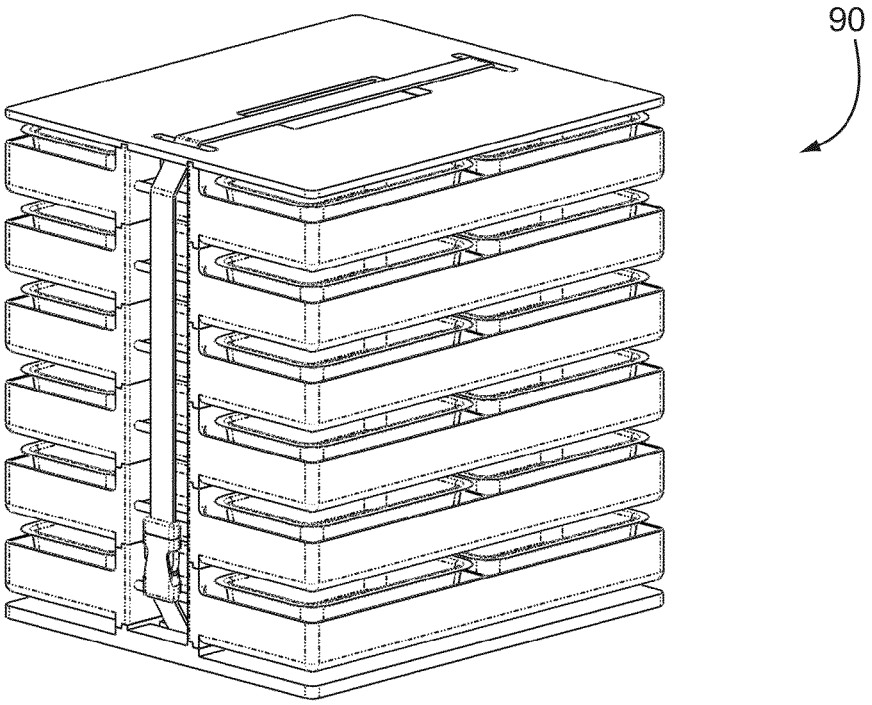
FIG. 8 shows a side perspective view of the configuration of FIG. 7, with the base and cover assemblies in place and secured.

FIG. 7 shows the stacked trays with meal casseroles 16 placed therein. The stackable tray system forms an assembled unit 90, as shown in FIG. 8, which represents a meal carrier that can be loaded directly into the induction oven.

Figure 9:
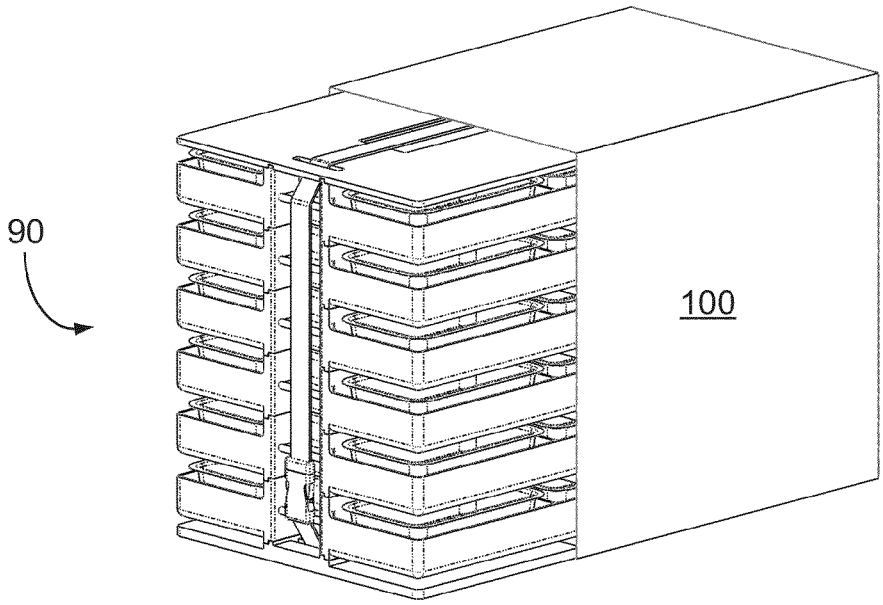
FIG. 9 shows a side perspective view of the configuration of FIG. 8 being inserted into or pulled out of an oven.
Figure 10:
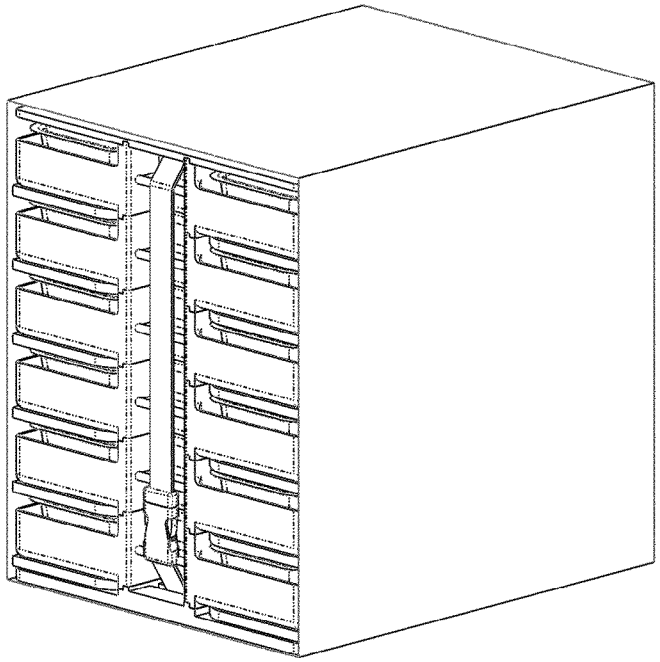
FIG. 10 shows a side perspective view of the configuration of FIG. 8 positioned in an oven.
Figure 11:
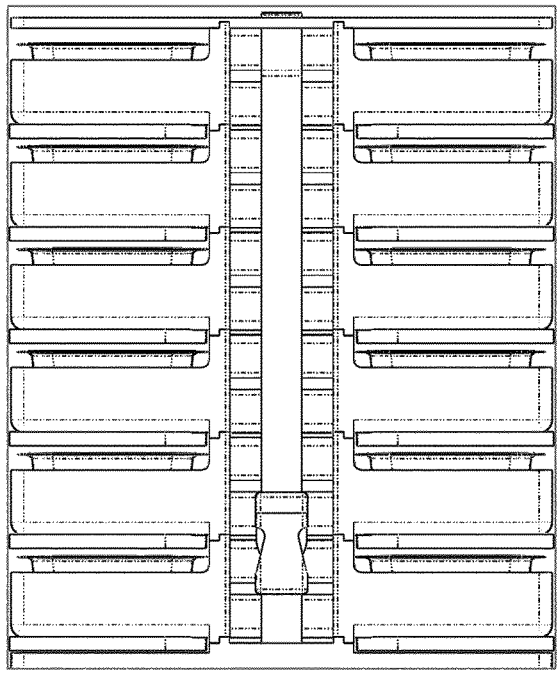
FIG. 11 shows a front plan view of the configuration of FIG. 8 positioned in an oven.
Figure 12:
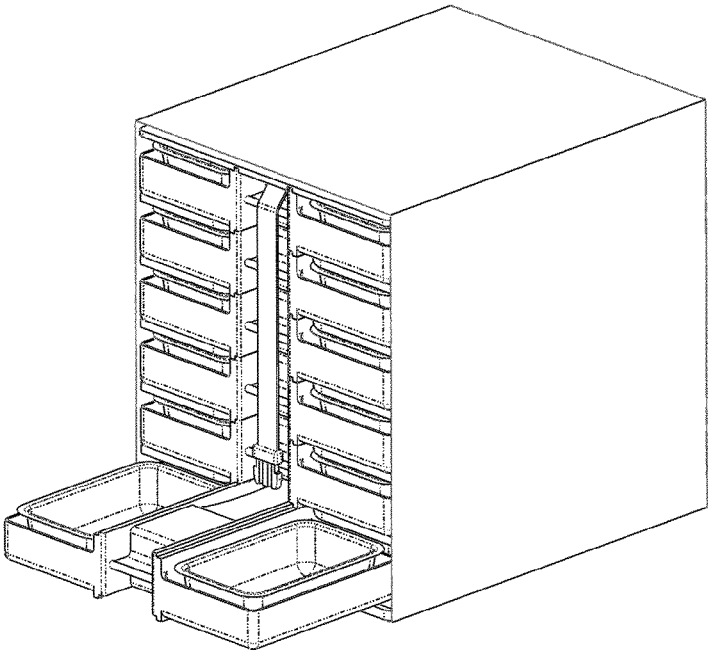
FIG. 12 shows a side perspective view of the configuration of FIG. 11, with one tray being pulled out.

FIG. 9 shows the assembled unit 90 being loaded in an induction oven 100. There is not a true front or back to the unit, and as such it can be loaded into the oven in either direction. (This is in contrast to some existing meal carriers, which can only be fitted into the oven in one direction.) The elements that secure the trays in a stacked position, including the securing system belt, may be used to push or pull the unit 90 into and out of the oven 100.

The trays, cover assembly, base assembly, ands securing system are typically made of non-metallic materials that are food-safe and suitable for use in a induction oven. Exemplary materials are thermoplastic materials, high temperature range plastics, polyethylene, phenolic, ultem, any combination thereof, or any other appropriate non-metallic material that can withstand high induction oven temperatures.

Once the casseroles are heated to the desired temperature, in-flight service can begin. The trays 10 are pulled from the unit 90 and the individual casseroles 16 can be removed, or the flight attendant may place an entire tray 10 on the food service cart. After use, the trays 10 (and typically the entire assembled unit 90) can be removed from the oven and sent back to catering for cleaning and re-use.

Changes and modifications, additions and deletions may be made to the structures and methods recited above and shown in the drawings without departing from the scope or spirit of the invention and the following claims.

What is claimed is:

1. A meal tray system designed for use with an induction oven, comprising:

(a) at least first and second stackable trays, each of the first and second stackable trays comprising a tray body comprising a plurality of casserole-receiving portions, a raised shoulder, and a lowered foot, wherein when stacked, the raised shoulder of the first tray is configured to abut the lowered foot of the second tray, creating a space between the first and second tray bodies, wherein the space between the trays when stacked is sufficient to allow a bottom of each tray to rest on an induction oven shelf for heating the casserole-receiving portions; and (b) one or more elements for securing the trays to one another when in a stacked configuration.

2. The meal tray of claim 1, wherein the one or more elements for securing the trays to one another comprise a base assembly, a cover assembly, and a securing belt system.

3. The meal tray of claim 1, wherein the plurality of casserole-receiving portions comprises an equal number of portions on a left side and a right side of the tray.

4. The meal tray of claim 1, further comprising a central divider.

5. The meal tray of claim 4, wherein the central divider comprises at least one handle.

6. The meal tray of claim 4, wherein the central divider comprises an inwardly curved surface to accommodate a user's hand during carrying.

7. The meal tray of claim 1, further comprising a positioning system to secure the trays in place once stacked.

8. The meal tray of claim 7, wherein the positioning system comprises a positioning notch on either an upper or a lower part of the first tray and a positioning protrusion on the other of an upper or a lower part of the second tray.

9. The meal tray of claim 1, wherein the casserole-receiving portions comprise rectangular-shaped indentations configured to receive pre-packaged meal casseroles.

10. The meal tray of claim 1, wherein the tray is comprised of a non-metallic material.

11. A meal tray system designed for use with an induction oven, comprising:

(a) at least first and second stackable trays, each of the first and second stackable trays comprising:

(i) a tray body comprising a central divider dividing the tray body into a left casserole-receiving portion and a right casserole-receiving portion;

(ii) each of the left and right casserole-receiving portions comprising an upper guiding rail and a lower guiding rail, such that the upper guiding rails of one tray cooperate in use with the lower guiding rails of another tray to create a space between stacked tray bodies, the space between the stacked tray bodies is sufficient to allow a bottom of each tray to rest on an induction oven shelf for heating the casserole-receiving portions;

(b) a base assembly; and (c) a cover assembly.

12. The meal tray of claim 11, further comprising a securing belt system configured to secure the base assembly to the cover assembly, with a plurality of stacked trays therebetween.

13. The meal tray of claim 11, further comprising a positioning notch on at least one of the upper or lower guiding rails of the first tray and a positioning protrusion on the other of the upper or the lower guiding rails of the second tray.

14. The meal tray of claim 11, wherein the left and the right casserole-receiving portions each comprise two rectangular-shaped indentations configured to receive pre-packaged meal casseroles.

15. The meal tray of claim 11, wherein the tray is comprised of a non-metallic material.

* * * * *